United States Patent [19]

Chow

[11] Patent Number: 5,077,098

[45] Date of Patent: Dec. 31, 1991

[54] PROCESS FOR REDUCING THE DISCOLORATION OF WOOD

[75] Inventor: Suezone Chow, Richmond, Canada

[73] Assignee: Canadian Forest Products Ltd., Vancouver, Canada

[21] Appl. No.: 472,716

[22] Filed: Jan. 31, 1990

[51] Int. Cl.[5] ..... B05D 7/06

[52] U.S. Cl. ..... 427/397; 427/440; 428/541; 106/18.29; 106/18.3; 106/18.32; 106/18.35

[58] Field of Search ..... 427/297, 397, 440, 393; 428/541; 252/607; 106/15.05, 18.29, 18.3, 436, 442, 444, 449, 461, 270, 18.32, 18.35, 286.1, 286.4, 286.6; 34/9.5, 13.8, 16.5

[56] References Cited

U.S. PATENT DOCUMENTS

| | | | |
|---|---|---|---|
| 4,218,516 | 8/1980 | Meyer et al. | 427/397 |
| 4,510,074 | 4/1985 | Nakai et al. | 427/440 |
| 4,737,154 | 4/1988 | Gaines et al. | 8/402 |
| 4,780,341 | 10/1988 | Chow | 427/440 |
| 4,801,404 | 1/1989 | Dietrich et al. | 427/440 |
| 4,911,988 | 3/1990 | Cass et al. | 34/9.5 |

FOREIGN PATENT DOCUMENTS

| | | | |
|---|---|---|---|
| 2132701 | 1/1973 | Fed. Rep. of Germany | 428/541 |
| 3633366 | 4/1988 | Fed. Rep. of Germany | 252/607 |
| 57-128294 | 8/1982 | Japan | 252/607 |
| 61-179289 | 8/1986 | Japan | 252/607 |
| WO82/03817 | 11/1982 | PCT Int'l Appl. | 427/440 |

*Primary Examiner*—Shrive Beck
*Assistant Examiner*—Terry J. Owens
*Attorney, Agent, or Firm*—Cooley Godward Castro Huddleson & Tatum

[57] ABSTRACT

A process for protecting wood by applying to the wood an aqueous solution of a composition comprising sodium borate and sodium carbonate. Adverse effects on the color of the wood are reduced by including in the composition a component selected from a weakly acidic compound able to form a complex with cellulose; the weakly acidic compound and titanium dioxide; an alkyl ammonium chloride; the weakly acidic compound and an alkyl ammonium chloride; and an alkaline earth metal hydroxide.

23 Claims, No Drawings

PROCESS FOR REDUCING THE DISCOLORATION OF WOOD

FIELD OF THE INVENTION

This invention relates to a process to improve colour and efficacy of anti-stain treatment for wood.

DESCRIPTION OF THE PRIOR ART

The wood species that constitute the main volume of commercial lumber have low resistance to sap stain, mould and decay. During summer months, green sap wood will be attacked by sap stain fungi in two or three weeks. The fungi produce black and blue stains which affect mainly the aesthetic value of the lumber. However, if further fungal growth continues decay can result. Anti-stain and decay treatment are therefore very important in lumber stored before drying or when shipped in green condition by ocean transport. During such transport warm and humid conditions may exist for several months.

In commonly owned U.S. Pat. No. 4,780,341, a method was described for protecting wood from staining by applying to the wood an equal solution of 4 to 30 parts by weight sodium carbonate, about 2 parts by weight of sodium borate, the balance being about 100 parts by weight water. This stain control is effective because of the ability of the applied composition to inhibit the growth of fungi by presenting high alkalinity, by modifying wood sugars through the formation of boron complexes and by forming a layer of inorganic elements in the wood surface to isolate wood from the fungal spores of fungi, thus denying food to the fungi.

The process of the above U.S. patent is commercially available under the trade mark ECOBRITE. It has proved a considerable success in providing lumber with good biological stain protection. However, it has been observed that some treated wood species darken. This is not significant in spruce, pine and amabilis fir but its effect on hemlock and Douglas fir is more pronounced.

SUMMARY OF THE INVENTION

The present invention therefore seeks to provide a process in which this adverse darkening can be reduced.

The invention provides two main approaches. First incorporating brightening agents to the solution capable of forming complexes with the anti-stain chemicals to provide enhanced efficacy and a corresponding reduction in the amount of protection solution required. In this regard of course the application of less sodium borate/sodium carbonate composition produces less wood surface colour. Secondly, introducing compounds that chemically fix the anti-stain compounds to minimize the effects of water erosion or washout of these chemicals while at the same time enhancing the light colour of the wood.

With certain wood species the presence of extractives or reacted chemicals capable of forming conjugated chemical bonds is believed to be a major factor in leading to the darkening of the wood surface. In some instances this darkening extends below the surface. Exposure to light, both natural and artificial, often initiates colour formation while trace metals, oxidizing agents and alkalinity accelerate colour development. Aromatic extractives, particularly tannins, are believed to be extensively involved in the mechanism whereby colour formation occurs. Some of the more alkaline anti-stain treatment chemicals tend to promote darkening of the wood surface in hemlock and Douglas fir. Adjustment in the sodium carbonate to sodium borate formulation ratio reduces alkalinity and thus helps to control this colour formation but other procedures have been found to be more effective.

Accordingly the present invention provides a process for treating wood by applying to the wood a composition including sodium borate and sodium carbonate. However, according to the present invention the process is improved by including in the composition a component selected from the group consisting essentially of a weakly acidic compound able to form a complex with cellulose, the above compound weakly acidic compound and titanium dioxide, an alkyl ammonium chloride, the above weakly acidic compound and an alkyl ammonium chloride and an alkaline earth metal hydroxide.

The present invention is based on the observation that use of a weakly acidic compound able to form a complex with cellulose and that strongly associates with the anti-stain formation to give it a reduced alkalinity while still retaining efficacy is an effective means of reducing colour.

Examples of weakly acidic compounds include certain acidic salts of calcium, magnesium, barium and zinc and certain oxides of aluminum. However, the preferred compound is boric acid.

Further work has shown that even better colour effects are achieved by introducing limited amounts of titanium dioxide into the formulation that also includes the weakly acidic compound. It is a characteristic of many titanium compounds that they strongly associate with polar, organic materials. Four valent titanium can achieve a coordination number up to 6 by sharing electron pairs with polar groups in both the wood and the anti-stain formulation. This enhances the fixation of the borate and carbonate onto the wood surface. The crystalline form of titanium dioxide also is characterized by a high refractive index and a low absorption of visible light. These factors combine to give the wood surface a light and bright colour appearance. The physical and chemical nature of this titanium compound is such that the light colour of the wood becomes more evident as light intensity increases. The positive effects of this additive on colour development is indicative of the titanium compound having a strong association with tannins present in wood to prevent further conjugation of these compounds. This can effectively reduces serious dark colour formations resulting from the oxidation of tannin, especially in hemlock.

A further approach is to incorporate compounds into the formulation that further enhance efficacy and allow reduced levels of carbonate and borate. Wood surface alkalinity is reduced and colour stabilized by the addition of small quantities of a quaternary ammonium compound, namely an alkyl ammonium chloride, to the anti-stain formulation. Preferred quaternary compounds are dialkyl quaternary compounds, for example, octyl decyl dimethyl ammonium chloride, and octyl dodecyl dimethyl ammonium chloride. However, the preferred compound is didecyl dimethyl ammonium chloride (QUAT); the bromide has also been used.

It has also been observed that wood surface colour improvements can be achieved by introducing compounds that fix the anti-stain compounds into the wood while also enhancing the light colour of the wood surface. The addition of small quantities of alkaline earth metal hydroxides, for example calcium hydroxide, can also be effective in enhancing the development of light colour on the wood surface while fixing anti-stain chemicals. The presence of the basic alkaline earth compound results in precipitation of the corresponding carbonate, which imparts a white, powdery surface to the treated wood.

EXPERIMENTAL WORK

The invention is further illustrated in the examples. In these examples, for brevity and convenience, sodium carbonate is identified by the letter C, sodium borate by B, and boric acid by A. The subscript numbers attached indicate percentage concentrations of each chemical by weight in the solution.

EXAMPLE 1

Colour Modification of the Wood Surface with the Addition of Boric Acid

Anti-stain chemicals having concentrations of C10B2, C8B2 and C6B2 were prepared. To each solution at a temperature of 50° to 60° C., 1, 2, 4, and 6% of boric acid by weight was added separately. These chemicals were used to spray on green, never dried, matched hemlock and Douglas fir wood samples (6 inches long, cut from 2×4 inch cross-sections of 10 foot long lumber). Before treatment, the surface colour and brightness were measured with a colour reflectance spectrophotometer. Surface brightness of the identical area was measured again after chemical spraying. Three replicates were used for each treatment.

The relationship between brightness and chemical treatment is shown below:

| Wood Species | Sapstain Formulation | Surface Brightness+ at Boric Acid Concentration (%) 0 | 1 | 2 | 4 | 6 |
|---|---|---|---|---|---|---|
| Douglas fir | C6B2 | 52.3 | 55.2 | 56.6 | 60.6 | 60.5 |
| | C8B2 | 50.5 | 54.0 | 55.7 | 55.4 | 55.0 |
| | C10B2 | 46.6 | 49.1 | 49.5 | 52.4 | 56.6 |
| | AV. | 49.6 | 52.8 | 53.9 | 56.1 | 57.4 |
| Hemlock | C6B2 | 61.6 | 60.1 | 61.5 | 62.0 | 62.5 |
| | C8B2 | 59.0 | 60.7 | 61.8 | 62.4 | 62.7 |
| | C10B2 | 56.0 | 59.4 | 60.6 | 61.5 | 62.5 |
| | AV. | 58.8 | 60.1 | 61.3 | 62.0 | 62.6 |

+higher values indicate greater brightness.

From the above results it is clear that the addition of a trace amount of boric acid can improve the surface brightness of the wood. The higher the concentration of boric acid added the brighter is the anti-stain chemical treated surface.

A larger scale experiment with 12 replicates for each treatment were prepared using Douglas fir and hemlock lumber and a 2% boric acid addition. The results of the experiment are shown below.

| Chemicals | Surface Brightness Boric Acid Addition (%) Douglas Fir 0 | Douglas Fir 2 | Hemlock 0 | Hemlock 2 |
|---|---|---|---|---|
| B2 | 52 | 59 | 57 | 57 |
| C1B2 | 52 | 61 | 53 | 57 |
| C2B2 | 51 | 60 | 53 | 56 |
| C3B2 | 46 | 59 | 52 | 54 |
| C4B2 | 46 | 59 | 52 | 54 |
| C5B2 | 47 | 57 | 50 | 53 |
| C6B2 | 44 | 51 | 51 | 53 |

-continued

| Chemicals | Surface Brightness Boric Acid Addition (%) Douglas Fir 0 | Douglas Fir 2 | Hemlock 0 | Hemlock 2 |
|---|---|---|---|---|
| C8B2 | 45 | 51 | 51 | 53 |
| C10B2 | 43 | 48 | 50 | 55 |

EXAMPLE 2

The Efficacy of Boric Acid Addition

Spruce-pine-fir (SPF) lumber, which as a group is more sensitive to fungi growth, and hemlock lumber were used to test the efficacy of boric acid additives in the anti-stain chemical formulation. SPF veneers, 12"×12"×0.1" thick were split into 12 pieces each of one inch width. Five replicates were used for each treatment. The chemical treatments are indicated in the following Table. Each of the treated wood specimens were then sprayed with fungi water solution. They were wrapped in plastic for incubation at 20° to 25° C. while fungal growth was observed.

| Chemical | Biological Stain Index After 2 Months of Incubation S-P-F | HEMLOCK |
|---|---|---|
| No treatment (control) | 7 | 2 |
| C6B2A0 | 0.5 | 0 |
| C6B2 (A2 to A6) | 0 | 0 |
| C8B2A0 | 0 | 0 |
| C8B2 (A1 to A6) | 0 | 0 |
| C10B2A0 | 0 | 0 |
| C10B2 (A1 to A6) | 0 | 0 |

The above data showed that the addition of the boric acid did not reduce the efficiency of anti-stain chemicals. The addition of a trace amount of boric acid to the anti-stain chemicals is proven to be beneficial for brightening the wood surface without downgrading efficacy.

EXAMPLE 3

Improving Wood Surface Brightness by Addition of Titanium Dioxide to the Anti-Stain Formulation A series of anti-stain chemicals containing titanium dioxide and wax were applied to green, never dried hemlock wood samples (48 inches long cut from 4×4 inch cross-sections of timbers). Prior to treatment the wood surface colour and brightness were measured at 6 locations with a colour reflectance spectrophotometer. After chemical treatment by spraying pieces at either 4 or 7 g/ft$^2$, the surface brightness was again measured at the same locations. At each treatment condition samples were stored either outdoors, in direct exposure to rain and sunlight, or indoors, but exposed to natural light. The lumber surfaces during outdoor storage were either directly exposed to the environment (that is on the outside of the storage pile) or partially protected by having their surfaces inside the storage pile. Average colour changes were measured after an exposure period of up to 49 days. The results for different treatments at full outdoor exposure are shown in Table A.

TABLE A

| Treatment | Spray Level g/ft$^2$ | Outdoor Exposure Time (Days) 9 | 22 | 49 |
|---|---|---|---|---|
| C8B2A2 + 0.5% $TiO_2$ + 1% Wax | 4 | +0.2 | −1.5 | −1.6 |
| C8B2A2 + 0.5% $TiO_2$ + 1% Wax | 7 | +1.3 | +1.5 | +0.5 |
| C8B2A2 + 0.5% $TiO_2$ + 2% Wax | 4 | +1.1 | +1.7 | +1.2 |
| C8B2A2 + 0.5% $TiO_2$ + 2% Wax | 7 | +2.4 | +2.6 | +2.5 |
| CONTROL (no treatment) | | −1.5 | −3.0 | −10.5 |

Here negative difference values indicate darkening of the wood while positive values indicate brightening of the wood relative to the initial wood colour. After various exposure times most of the treatment conditions show consistently better brightness than the control. In fact, the brightness is better than the initial green, untreated wood.

The colour change at a specific location on each sample is shown in Table B for different types of exposure. This shows a similar trend to the average values presented in Table A. This data demonstrates the effectiveness of including small quantities of titanium dioxide in the formulation to improve colour brightness in hemlock.

TABLE B

COLOUR CHANGE AT ONE SPECIFIC AREA ON HEMLOCK LUMBER

| Formula | Spread Level (g/ft$^2$) | Unit Change in Colour Reflectance From Initial Lumber Colour: Exposed, INDOOR (days) 10 | 22 | 49 | Exposed, OUTDOOR (days) 10 | 22 | 49 | Unexposed, OUTDOOR (days) 10 | 22 | 49 |
|---|---|---|---|---|---|---|---|---|---|---|
| C8B2A2 + 0.5% $TiO_2$ + 1% Wax | 4 | +0.6 | −0.5 | −2.0 | +2.9 | +2.3 | +0.2 | 0.1 | −6.8 | −2.3 |
| C8B2A2 + 0.5% $TiO_2$ + 1% Wax | 7 | +1.1 | +1.9 | −1.1 | +1.4 | +1.8 | +0.7 | +1.9 | +1.9 | +1.7 |
| C8B2A2 + 0.5% $TiO_2$ + 2% Wax | 4 | +0.8 | +1.9 | −0.8 | +0.9 | +1.9 | +0.1 | +3.8 | +4.6 | −0.4 |
| C8B2A2 + 0.5% $TiO_2$ + 2% Wax | 7 | +6.4 | +6.4 | +4.6 | +2.0 | +2.3 | +2.4 | +1.7 | +2.0 | +2.0 |
| CONTROL | | −4.9 | (16 days) | | −2.7 | (16 days) | | | | |

EXAMPLE 4

Treatment of Hemlock with High and Low Tannin Content with Titanium Dioxide Modified Anti-Stain Formulation Colour darkening of hemlock lumber is believed to result from the photochemical reaction of tannins during exposure of the wood surface to light. A series of tests were undertaken to determine if titanium dioxide could limit this reaction while enhancing brightness of the lumber. Green, 4×4 inch cross-sections, 16 feet long were inspected for the presence of tannin and sorted into high and low tannin samples. Each group was treated, under mill conditions, with an anti-stain formulation of C8B2A2 alone or C8B2A2 containing 0.5% titanium dioxide and 2% wax. Wood surface colour was then measured at two positions using a colour reflectance spectrophotometer. The instrument was set up to measure overall colour lightness, red colour intensity and yellow colour intensity. Treated lumber was stored either at outdoor exposure or inside a building. Colour changes at the initially measured positions were determined after two weeks of aging. These differences are presented in the following Table.

| | COLOUR DIFFERENCE: Low Tannin Sample light | red | yellow | High Tannin Sample light | red | yellow |
|---|---|---|---|---|---|---|
| Control (outside) | −0.7 | −0.6 | +5.3 | −14.5 | +7.1 | +9.0 |
| $TiO_2$ (outside) | −3.6 | +1.7 | +4.6 | −1.0 | −2.0 | −7.3 |
| Control (inside) | −5.0 | +0.6 | −2.5 | +7.4 | +0.6 | +1.4 |
| $TiO_2$ (inside) | −1.3 | +0.3 | −2.5 | +3.5 | −1.2 | −4.5 |

The data shows that with outdoor exposure, high tannin content samples undergo substantial darkening of the wood surface with corresponding increases in red and yellow tones. Incorporation of $TiO_2$ results in essentially no darkening and a reduction in red and yellow tones. Low tannin content samples and lumber stored inside were not affected to the same extent. These results demonstrate that $TiO_2$ interacts with tannin to inhibit the photochemical reactions which darken the colour of wood. The mechanisms likely involve strong association of the Ti atom through the phenolic and/or ring hydroxyl groups of tannin. The resulting complex limits further formlation of conjugated bond, the systems which are responsible for colour formation. Amounts of $TiO_2$ in the range 0.5 to 2% by weight of the composition were effective.

EXAMPLE 5

Efficacy of Formulations Containing $TiO_2$

Green hemlock timbers, 4×4" cross-section by 12 feet long were treated with C10B2A2 formulations containing either one or two percent $TiO_2$. Spray treatment levels were applied at approximately 7 g/ft$^2$. These wood pieces were stored outside for a three months period in summer during which rainfall frequently occurred. The pieces were inspected for stain and showed the following results:

| Treatment | No. Pieces Inspected | Stain Index | % Clear | % Stain | % Reject |
|---|---|---|---|---|---|
| C10B2A2 + 1% $TiO_2$ + 1% Wax | 66 | 0.10 | 90 | 10 | 0 |
| C10B2A2 + 2% $TiO_2$ + 1% Wax | 66 | 0.09 | 91 | 9 | 0 |

The data indicates that inclusion of $TiO_2$ into the formulation does not alter efficacy of the anti-stain formulation.

The wax is added to provide water repellency. The wax used is generally a paraffin wax sprayed as an aqueous emulsion.

EXAMPLE 6

Incorporation of Alkyl Ammonium Compound into the Anti-Stain Chemical Formulation to Improve Brightness and Efficacy in Wood There are two ways to improve the brightness of wood species whose surface colour is sensitive to the anti-stain chemicals; one is by addition of brighteners such as demonstrated in the previous example using compounds such as boric acid. The other way is to reduce the volume of the anti-stain chemical while enhancing the efficacy of these applied chemicals.

In this example this principle is demonstrated through the addition of a quaternary alkyl ammonium compound into the ECOBRITE anti-stain formulation. Experiments were undertaken with southern pine veneer. This wood species is very fungi sensitive and was obtained as a ⅛ inch thick veneer from the state of Louisiana. The green veneers were split into one inch widths and were treated with didecyl dimethyl ammonium chloride (QUAT) and also with a combination of different amounts of QUAT and ECOBRRITE. The wood samples were sprayed with these chemicals and then set aside for 30 minutes, whereupon fungi spore solution was sprayed on the surface. The veneer strips were then wrapped with plastic sheets for incubation at 20° C. to 25° C. while fungal growth was observed.

Efficacy test results were as follows:

| Chemicals | Biological Stain Index After Six Months Incubation | |
|---|---|---|
| | with water | with C10B2 solutions |
| wood only | 7.6 | — |
| 0.01% QUAT | 4.5 | 1.7 |
| 0.05% QUAT | 3.5 | 2.2 |
| 0.1% QUAT | 5.0 | 1.0 |
| 0.2% QUAT | 5.0 | 0.5 |
| 0.5% QUAT | 3.7 | 0.3 |
| 1.0% QUAT | 5.3 | 0.1 |
| 2.0% QUAT | 2.5 | 0 |
| 5.0% QUAT | 2.0 | 0 |
| 10.0% QUAT | 0.5 | 0 |

QUAT = didecyl dimethyl ammonium chloride

The above results demonstrated that this quanternary ammonium chloride compound alone is required at concentrations as high as 10% to have the effect of complete fungi control. ECOBRITE itself in the early period of incubation showed no signs of fungi growth. However, after 6 months the ECOBRITE treated samples showed minor fungal growth. The addition of trace amounts of quaternary ammonium compound to the ECOBRITE reduced fungal growth. With additional levels of 0.1 to 0.2% QUAT to ECOBRITE, the efficacy of the mixture approaches that of 10% QUAT alone.

EXAMPLE 7

Treatment of Spruce-Pine-Fir and Hemlock with Anti-Stain Chemicals and Alkyl Ammonium The Canadian spruce-pine-fir (SPF) group and hemlock species were used to examine the efficacy effect for a whole range of chemical treatments. SPF and hemlock veneer samples were prepared as in Example 3. To each of the standard treatment chemicals C2B2, C4B2, C6B2, C8B2, C10B2, were added 2, 4, or 10% QUAT in water solution. After treatment the samples were incubated at 20° to 25° C. and their stain index determined after 10 months. The results were as follows:

| Wood Species | Chemicals | Biological Stain Index (10 months) |
|---|---|---|
| spruce-pine-fir | Control | 6.5 |
| | C2B2 | 1.5 |
| | C2B2 + 2,4,or 10% QUAT | 0 |
| | C4B2 | 1.5 |
| | C4B2 + 2,4,or 10% QUAT | 0 |
| | C6B2 | 0.5 |
| | C6B2 + 2,4,or 10% QUAT | 0 |
| | C8B2 | 0 |
| | C8B2 + 2,4,or 10% QUAT | 0 |
| | C10B2 | 0 |
| | C10B2 + 2,4,or 10% QUAT | 0 |
| Hemlock | C4B2 | 0 |

QUAT = didecyl dimethyl ammonium chloride

The above data again demonstrates the usefulness of the addition of QUAT to enhance the efficacy of the ECOBRITE chemicals.

EXAMPLE 8

Efficacy of Combined Boric Acid and Quaternary Ammonium Compound Addition

In this test green Douglas fir veneer, 12×12 inches square was used. Two pieces of veneer were chosen for each treatment, one being sapwood, the other heartwood. The treatment formulation included: C2B2A2, C4B2A2, C6B2A2, and C10B2A2 with each mixture also containing either zero, 2 or 5% didecyl dimethyl ammonium chloride (QUAT). The treatments were applied at spray levels of 2, 4 or 7 g/ft$^2$. Each of the veneers were sprayed with fungal water solution and then wrapped in plastic for incubation at 20° to 25° C. After 84 days the samples were assessed for stain. The results are shown in the following Table:

| Treatment | | Average Stain Index % QUAT | | | | | |
|---|---|---|---|---|---|---|---|
| | Spray | 0 | | 2 | | 5 | |
| Formula | g/ft$^2$ | heart | sap | heart | sap | heart | sap |
| C2B2A2 | 2 | 2 | 1 | 0.5 | 1 | 0.5 | 0.5 |
| | 4 | 5 | 5 | 0 | 1 | 0.5 | 0.5 |
| | 7 | 0 | 1 | 0 | 0 | 0.5 | 0 |
| C4B2A2 | 2 | 1 | 2 | 1 | 1 | 0 | 0 |
| | 4 | 0.5 | 1 | 0 | 0 | 0 | 0 |
| | 7 | 0 | 0.5 | 0 | 0.5 | 1 | 0 |
| C6B2A2 | 2 | 2 | 0.5 | 0.5 | 0.5 | 0.5 | 0 |
| | 4 | 0 | 1 | 0 | 0 | 0 | 0 |
| | 7 | 0.5 | 0.5 | 0.5 | 0 | 0 | 0 |
| C10B2A2 | 2 | 1 | 3 | 0.5 | 0.5 | 0 | 0 |
| | 4 | 1 | 2 | 0 | 0 | 0 | 0 |
| | 7 | 0.5 | 0.5 | 0 | 0 | 0 | 0.5 |
| CONTROL | | 0.5,1,0.5,0.5 (heart) | | | | 4,5,5,5(sap) | |

The data indicates that addition of small amounts of QUAT to the boric acid modified formulation enhances the efficacy of the formulation. This allows a reduction in the amount of treatment chemical spray that need be applied.

EXAMPLE 9

Fixation Using Calcium Hydroxide with Subsequent Calcium Carbonate Formation to Minimize the Solubility of the Anti-Stain Chemicals Experiments were performed using hemlock lumber. Eight thousand board feet of green 2×4 inch cross-section, lumber were packaged in 16 piles. All packages were previously treated with C10B2 solution and were kept under wet conditions. Separate solutions of 5% and 10% concentration of lime water (calcium hydroxide) were mixed with 5% and 10% of wax emulsion solution to give four different mixtures. Groups of four piles of anti-stain chemical treated lumber piles were then sprayed with each of the lime water mixtures. From each of these groups, two piles were immediately covered with plastic sheeting to protect them from rainfall while the other two piles were placed outside under rain exposure within 10 minutes after the application of the lime-water-wax solution.

It was observed that all of the packages exhibited a white layer deposit on the surface of the lumber. This layer was not washed away by heavy rain even after 8 months of outside exposure. In applications where wax was also added to the solution, the white layer on the wood was not as evident as that for lumber sprayed with a solution excluding wax.

Observing the calcium hydroxide treated lumber surface under a stereomicroscope revealed that crystals of calcium carbonate were present below the lumber surface. This suggested that fixation of the treatment chemicals not only occurs on the wood surface but also inside the lumber. The above observations indicate that these methods can retard leaching of anti-stain chemicals from wood.

A further study was made of the efficiency of these chemicals on the suppression of fungi growth. Matched spruce-pine-fir veneer strips were used for this treatment. The test results indicated that spraying with lime water did not alter the efficacy of the ECOBRITE formulation.

Based on the mechanism of chemical reaction and the observed results from these experiments, it is reasonable to conclude that all the Group II hydroxides such as those of barium, magnesium and strontium will have the same effect as that of calcium hydroxide and render a fixation of the chemical treatment.

I claim:

1. In a process for protecting wood by applying to the wood an aqueous composition containing sodium borate and sodium carbonate, the improvement comprising supplementing the performance of said composition to reduce adverse effects on the color of the wood by including in the composition a component selected from the group consisting of a weakly acidic compound able to form a complex with cellulose, said weakly acidic compound and titanium dioxide, an alkyl ammonium chloride, said weakly acidic compound and an alkyl ammonium chloride and an alkaline earth metal hydroxide.

2. In a process for protecting wood by applying to the wood an aqueous composition containing sodium borate and sodium carbonate, the improvement comprising supplementing the performance of said composition to reduce adverse effects on the color of the wood by including in the composition a component selected from the group consisting of boric acid, boric acid and titanium dioxide, didecyl dimethyl ammonium chloride (QUAT), boric acid and QUAT and an alkaline earth metal hydroxide.

3. A process as claimed in claim 2 in which the sodium borate and sodium carbonate is admixed with boric acid alone.

4. A process as claimed in claim 3 in which the boric acid is present in the amount of 1 to 6% by weight of the composition.

5. A process as claimed in claim 2 in which the sodium borate and sodium carbonate is admixed with didecyl dimethyl ammonium chloride alone.

6. A process as claimed in claim 5 in which the didecyl dimethyl ammonium chloride is present in the amount of 0.01 to 10% by weight of the composition.

7. A process as claimed in claim 2 in which the sodium borate and sodium carbonate is admixed with an alkaline earth metal hydroxide alone.

8. A process as claimed in claim 7 in which the alkaline earth metal hydroxide is calcium hydroxide.

9. A process as claimed in claim 8 in which the calcium hydroxide is present in the amount of 5 to 10% by weight of the composition.

10. A process as claimed in claim 9 in which the composition includes a wax.

11. A process as claimed in claim 10 in which the wax is present in the range of 5 to 10% by weight of the composition.

12. In a process for protecting wood from sap stain, mould and decay by applying to the wood a composition comprising sodium borate and sodium carbonate, the improvement that comprises reducing any adverse effect on the colour of the wood by incorporating into the composition 1 to 6% by weight of boric acid.

13. A process as claimed in claim 12 in which the composition further includes titanium dioxide.

14. A process as claimed in claim 13 in which the composition includes about 0.5% by weight of titanium dioxide.

15. A process as claimed in claim 13 in which the composition further includes a wax.

16. A process as claimed in claim 15 in which the wax is present in the range of 1 to 2% by weight of the composition.

17. A process as claimed in claim 12 in which the composition further includes didecyl dimethyl ammonium chloride.

18. A process as claimed in claim 17 in which the composition includes 2 to 5% by weight of the didecyl dimethyl ammonium chloride.

19. In a process for protecting wood by applying to the wood an aqueous composition containing sodium borate and sodium carbonate, the improvement comprising subsequently treating the wet wood with an aqueous composition comprising an alkaline earth metal hydroxide.

20. A process according to claim 19 in which the alkaline earth metal hydroxide is calcium hydroxide.

21. A process according to claim 20 in which the calcium hydroxide is present in the amount of 5 to 10% by weight of the composition.

22. A process according to claim 21 in which the composition includes a wax.

23. A process according to claim 22 in which the wax is present in the range of 5 to 10% by weight of the composition.

* * * * *